United States Patent [19]

Clarke et al.

[11] Patent Number: 4,555,354

[45] Date of Patent: Nov. 26, 1985

[54] DETERGENTS PRODUCTS

[75] Inventors: David E. Clarke; James F. Davies; Colin Smart; John B. Tune, all of Merseyside, England

[73] Assignee: Lever Brothers Company, New York, N.Y.

[21] Appl. No.: 645,898

[22] Filed: Aug. 31, 1984

Related U.S. Application Data

[63] Continuation of Ser. No. 536,137, Sep. 26, 1983, abandoned, which is a continuation of Ser. No. 383,648, Jun. 1, 1982, abandoned, which is a continuation of Ser. No. 198,013, filed as PCT GB79/00189 Nov. 16, 1979, published as WO80/01076, May 29, 1980,§ 102(e) date Jul. 14, 1980, abandoned.

[30] Foreign Application Priority Data

Nov. 17, 1978 [GB] United Kingdom ..... 45105/78

[51] Int. Cl.[4] ..... C11D 17/04

[52] U.S. Cl. ..... 252/90; 252/92; 252/174; 206/0.5

[58] Field of Search ..... 252/90, 91, 92, 93, 252/174; 206/0.5

[56] References Cited

U.S. PATENT DOCUMENTS

| | | | |
|---|---|---|---|
| 3,322,674 | 5/1967 | Friedman | 252/90 |
| 3,549,381 | 12/1970 | Kisinger | 99/77.1 |
| 3,651,615 | 3/1972 | Bohner et al. | 53/28 |
| 3,661,695 | 5/1972 | Berliner | 161/151 |
| 3,859,125 | 1/1975 | Miller | 117/155 UA |
| 4,026,131 | 5/1977 | Dugger et al. | 68/17 A |
| 4,108,600 | 8/1978 | Wong | 8/137 |
| 4,170,565 | 10/1979 | Flesher | 252/93 |
| 4,188,304 | 2/1980 | Clarke | 252/93 |
| 4,227,614 | 10/1980 | Hollander, Jr. | 206/459 |
| 4,234,442 | 11/1980 | Cornelissens | 252/90 |

FOREIGN PATENT DOCUMENTS

| | | |
|---|---|---|
| 867039 | 11/1978 | Belgium . |
| 901244 | 5/1972 | Canada . |
| 2635257 | 2/1978 | Fed. Rep. of Germany . |
| 62159 | 11/1970 | Luxembourg . |
| 31346 | 11/1933 | Netherlands . |
| 950256 | 2/1964 | United Kingdom . |
| 961821 | 6/1964 | United Kingdom . |
| 1013014 | 12/1965 | United Kingdom . |
| 1164141 | 9/1969 | United Kingdom . |
| 1298454 | 12/1972 | United Kingdom . |

*Primary Examiner*—Paul Lieberman
*Assistant Examiner*—Hoa Van Le
*Attorney, Agent, or Firm*—Milton L. Honig; James J. Farrell

[57] ABSTRACT

A detergent-containing water-insoluble closed bag is so constructed as to open and discharge its contents under mechanical action in a washing machine in use. The seams of the bag may be heat-sealed or cold pressure sealed such that at least one seam will burst open in use. The bag material may be porous with a pore size selected to minimize dusting of the detergent. The bag material may include a thermoplastic component to enable heat-sealing. The bag may contain conventional detergent compositions and/or other fabric treatment materials. These products give consumer benefits both by way of improved efficiency in the use of the detergent compositions and in greater convenience in use.

2 Claims, No Drawings

DETERGENTS PRODUCTS

This is a continuation application of Ser. No. 536,137, filed Sept. 26, 1983, now abandoned, which in turn is a continuation of application Ser. No. 383,648, filed June 1, 1982, now abandoned, which in turn is a continuation of application Ser. No. 198,013, filed as PCT GB 79/00189, Nov. 16, 1979, published as WO 80/01076, May 29, 1980, § 102(e) date July 14, 1980, now abandoned, which in turn was based on International Application No. PCT/GB 79/00189 having an International Filing Date of Nov. 16, 1979.

TECHNICAL FIELD

This invention relates to detergent products which are suitable for treating fabrics in a washing machine and which contain detergent compositions in particulate form.

BACKGROUND ART

Although the marketing of particulate detergent compositions packaged in cartons is common practice, this imposes constraints both on their formulation and methods of production. For example the compositions must be free flowing and have an attractive appearance to the consumer, and the ingredients should not segregate during transport and storage. The products must also be safe, both for contact with the skin and in the event of accidental ingestion; in particular, the compositions should not contain too high a level of alkaline material, although alkalinity is beneficial for detergent properties.

When using washing machines which have a rotating drum in which the fabrics are placed, there can also be substantial losses of conventionally dosed detergent powder by retention in the dispenser and by its accumulation in the dead spaces beneath the drum, such as the drain hose.

In our Belgian Pat. No. 867 039 (U.S. application Ser. No. 905,680) there are described detergent products which comprise particulate detergent compositions contained within a closed water-insoluble bag which has a water-sensitive seal, whereby the contents of the bag are discharged on contact of the bag with water. These products give consumer benefits both by way of improved efficiency in the use of the detergent compositions and in greater convenience of use.

DISCLOSURE OF INVENTION

We have now found that alternative ways of opening a bag during use can be beneficial, especially in the ease of manufacture of the products. Accordingly, the present invention provides a detergent product which comprises a particulate detergent composition contained within a closed water-insoluble bag and which has means for opening the bag and discharging its contents under the influence of mechanical action in the washing machine during use.

The closed water-insoluble bag may be formed of natural or synthetic, woven or non-woven materials, which preferably are water-permeable. The means for opening the bag and discharging its contents under the influence of mechanical action in the washing machine during use may be constituted by closing the bag with at least one weak seal. While the preferred detergent formulation is a fully formulated detergent composition, it may be constituted by other fabric treatment materials.

Detergent products of the invention possess all the benefits of the detergent products described in our aforementioned Belgian Pat. No. 867 039, but are also capable in the preferred embodiment of being made more easily and more cheaply. In particular it is possible to form, fill and then seal the bags more readily than by using water-soluble adhesives.

The mechanism whereby the bag opens in use depends, in the case of a bag with a weak seal, primarily on the strength of the weak seal, in particular its peel strength, and also on a number of other factors such as, for example, the quantity of detergent composition contained in the bag, the porosity of the bag material, the weight and nature of the load which is placed with the bag into the washing machine, and the functional characteristics of the washing machine. Preferred detergent products of the invention will open within 5 minutes, more preferably within 2 minutes of the start of the washing process when placed in a front loading automatic washing machine such as the Hoover Electronic 1100 on any of its cycles, together with a load consisting of between 1 and 4 kg of terry towelling and/or cotton sheeting.

However, the products of the invention are applicable to both front-loading and top-loading automatic washing machines, and also to non-automatic washing machines.

BEST MODE OF CARRYING OUT THE INVENTION

The bag may be formed of paper, woven, knitted or non-woven fabrics, or plastics sheet material.

The material used to form the bags should be water-insoluble but preferably water-permeable with a pore size such that there is no excessive dusting of the detergent composition through the material of the bags in the dry state but yet that water can pass readily through the material forming the bags when the product is used. This assists prompt opening and discharge of the contents of the bags.

If desired, the sheet material of the bags may be treated with a protective agent to increase its resistance to chemical attack by the detergent composition, for example by coating the sheet material with a water-soluble substance, e.g. a water-soluble cationic detergent active material or soap, or by providing an extra protective layer of a water-soluble sheet material such as soluble polyvinyl alcohol. If the bags are to be used for detergent powder which consists of or contains a bleaching agent, for example sodium perborate or sodium percarbonate, it is desirable to form the bags of sheet material made from oxidation-resistant fibres, or to treat the sheet material before or after forming the bags with a coating to improve oxidation resistance. Alternatively, the sheet material of the bag may be treated with a removable water-insoluble protective agent such as a silicone, a fatty acid, a water-insoluble cationic fabric softening agent, wax or clay. Some of these treatments may tend to inhibit dusting, so sheet materials with somewhat larger maximum pore sizes can be used, which facilitates the rapid dispersion or dissolution of the detergent compositions in water.

A suitable sheet material for forming the bags is water-permeable paper or non-woven fabric of high wet strength, weighing about 5 to 100, preferably 10 to 60 $g/m^2$, especially about 15 to 40 $g/m^2$, such as is commonly used for packaging beverage powders and other foodstuffs, and suitable sheet materials of this type are commercially available for example from J R Crompton Bros Ltd of Bury, England.

The fibres preferably used for the sheet materials may be of natural or synthetic origin and may be used alone or in admixture, for example polyamide, polyester, polyacrylic, cellulose acetate, polyethylene, polypropylene, PVC, PVdC (polyvinylidene chloride) or cellulosic fibres. If some cellulose pulp fibres are used, it may be desirable to include a proportion of long fibres such as Manila hemp, in order to improve the strength of the sheet material, and pliability, and reducing stiffness, thereby giving the material a fabric-like appearance and a binder may also be necessary for increasing wet strength. It is preferred to include at least a proportion of thermoplastic fibres, for increasing resistance to chemical attack by any of the ingredients of the detergent compositions.

The preferred bags of the invention open by the bursting of at least one weak seal, which is strong enough to resist opening during transport and manual handling but which will open readily when the bag is agitated in the washing machine. The seals are preferably formed by heat-sealing or by cold pressure sealing. In the case of a bag formed from a non heat-sealable or non-pressure sealable material, for example cellulosic material, it is advantageous to include in the bag material a proportion of a thermoplastic material, such as polypropylene fibres to enable the bag to be heat sealed. Alternatively, the bag material may be provided with a layer of a heat sealable or pressure sealable material over all of its surface or only locally where the seal is to be made. Thus, cellulosic material may be locally coated with a vinyl acetate/vinyl chloride copolymer and heat sealed.

Where it is desired to form the bag with more than one heat seal, only one of which is a weak seal, then the seals may be made with different sealing temperatures, times and/or pressures.

In the case of a bag material which consists of, or contains a large proportion of, a thermoplastic material, such as polypropylene, it may be difficult to produce a seal weak enough to open in the wash, if direct heat-sealing is used. This may be overcome by locally coating the bag material with a non-heat-sealable material or by inserting between the surfaces of the bag material which are to form the weak seal, a layer of non-heat-sealable material, such as paper, or non-woven synthetic fabric, thereby to weaken the seal. A particular embodiment of the invention therefore comprises a heat-sealed bag formed of polypropylene, one seal being formed with a paper insert strip. The paper strip may be provided on one face of the polypropylene sheet before the bags are made and filled, or may be inserted during heat sealing.

The bag may also be formed of a material comprising or consisting of two components which heat seal at different temperatures, such as a polyester and polypropylene. In this case the weak seal or seals are formed by selecting a sealing temperature at which only one of those components heat seals, the remaining seals being formed by selecting a sealing temperature at which both of those components heat-seal.

An alternative method of enabling the bag to open and discharge its contents in use is to form at least part of the bag of a material which will disintegrate in use. This may be achieved, for example, by using as the bag material, a fabric material of low wet strength, for example a plastics or cellulosic material fabric which incorporates little or no binder or incorporates a water soluble binder such as starch, dextrin or soluble PVA latex. Also the bag material may be paper which has not been treated with a wet strength agent. In these embodiments the bag disintegrates on contact with water in the washing machine causing the bag to open and discharge its contents into the wash liquor.

A still further method of enabling the bag to open and discharge its contents in use, is to form the side walls of the bag with weakened areas, e.g. in the form of linear slit perforations with a manually removable protective strip positioned thereover. Opening of the bag then occurs by bursting at the weakened areas.

The preferred bags are made with cellulosic fibres treated with heat-sealing agent, or from mixtures of cellulosic fibres with thermoplastic fibres.

The bags can be formed from a single folded sheet formed into a tubular section, or from two sheets of the material bonded together at the edges. For example, the bags can be sachets formed from single folded sheets and sealed on three sides or from two sheets sealed on four sides for the preferred rectangular shape.

Alternatively the sheets can be folded like envelopes with overlapping flaps to be sealed.

The bags may be formed from two sheets of different material, one of which heat-seals at a relatively low temperature (e.g. polypropylene) and the other of which heat-seals at a relatively high temperature (e.g. polyester) or does not heat-seal (e.g. paper).

Any detergent composition in particulate form can be packaged to advantage in the products of the invention. As an alternative to fully formulated detergent compositions (that is a composition containing at least a surfactant and a builder) the bags may contain any one or more of the following fabric treatment materials: bleaches such as sodium perborate; bleach precursors such as tetraacetylethylene diamine (TAED); fabric softeners such as quaternary ammonium compounds; starch; perfumes; anti-bacterial agents; anti-static agents; whitening or blueing agents; stain removing agents and the like. It can be of particular advantage to add fabric treatment materials to the wash in a bag while dosing a fully formulated detergent composition in a conventional manner, where the incorporation of the fabric treatment material in the fully formulated detergent composition may otherwise be difficult. This is of particular importance in the case of perfumes, bleaches, bleach precursors and cationic fabric softening agents.

The fully formulated compositions which can be packaged to advantage in the products of the invention are amply described in the literature, for example in "Surface Active Agents and Detergents", Volumes I and II, by Schwartz, Perry and Berch.

However, the products of the invention are advantageously used for detergents powders containing insoluble ingredients. Specific examples of such ingredients include finely divided calcium carbonate, the use of which is described in UK Pat. No. 1 437 950, and sodium aluminosilicate ion-exchange materials as described in UK patent specification Nos. 1 429 143, 1 473 201 and 1 473 202.

It is also advantageous to use the products of this invention with detergent compositions containing bleach systems, particularly containing TAED and sodium perborate.

In addition, the detergent products of the invention are particularly suited for detergent compositions of relatively high bulk density, i.e. over about 0.5 g/cc, preferably about 0.6 to 0.8 g/cc, up to a maximum of about 1 g/cc, above which there tends to be a reduction in the rate of water solubility or dispersibility. The use of high bulk density compositions makes it possible to decrease the size of the detergent bags whilst still containing enough particulate detergent composition to be fully effective during use. This also enables the use of simple processing techniques for the production of the detergent compositions themselves, e.g. granulation or dry mixing instead of traditional spray drying techniques.

The particle size distribution of the detergent composition should preferably be selected in relation to the pore size distribution of the sheet material so that no more than about 5% by weight, preferably no more than about 1% of the particles can pass through the sheet material in the dry state, and hence cause dusting. Bags for very fine powders, for example made by dry mixing, should preferably be made from sheet material having a very small maximum pore size so as to allow only detergent particles less than about 20 microns to dust from the bag on handling or in transit. Bags for coarser grained detergent powders should preferably be made from sheet material having a maximum pore size so as to allow only detergent particles less than about 100 microns, to dust from the bag.

If desired, the bags can be formed with more than one separate compartment containing different detergent. ingredients at least one of which compartments is adapted to open in the wash, or the bags may be formed in a conjoined manner, for example in a strip to facilitate dosing of different numbers of the bags as appropriate for the wash conditions. The use of multi-compartment bags facilitates the use of detergent ingredients which would otherwise interact with other ingredients in detergent compositions, whilst avoiding encapsulation or other treatment to prevent contact between such ingredients in a single composition.

For example one opening compartment may contain a fully formulated detergent free of bleach while a non-opening second compartment may contain the bleach. Other bag shapes or constructions, for example circular cushion shaped sachets or of tetrahedron form, may be used if desired. The bags may also be reinforced, if desired, to decrease the risk of leakage during handling, for example by adding an extra thickness of the sheet material where the bags are expected to be held or passing completely round the bags to help support the weight of detergent powder.

In preferred embodiments of the invention, the bag is generally rectangular being sealed on either three or four edges. In the case where the bag is sealed along three edges, the fourth edge is formed by a fold in the bag material. In the case where the bag is sealed along all four edges, it is not desirable for all four seals to open in use. It is therefore preferred in such cases that no more than three such seals should be capable of opening under mechanical action in the washing machine in use.

If desired, the sheet material used to form the bag can be marked or tagged so that it can be easily recognised amongst the washed fabrics, for example the material may be printed with a simulated fabric pattern such as check or gingham. It can then either be discarded, or, if desired, it may be constructed of a suitable material to provide it with a secondary use, for example as a cleaning cloth. The invention is illustrated by reference to the following Examples in which parts and percentages are by weight except where otherwise incidated.

EXAMPLES 1 AND 2

Detergent bags were made from two water-permeable papers, made as follows:

Example 1—cellulosic paper fibres treated with Kymene polymeric wet strength agent and with a 20:80 vinyl acetate/vinyl chloride copolymer as heat-sealing agent, giving a final weight of 26 g/m$^2$.

Example 2—cellulosic fibres (Manila hemp 70%, polypropylene thermoplastic fibres 30%) treated with acrylic latex wet strength agent.

Both types of bags were made by folding in half sheets of 9"×4½" and heat-sealing the two opposing sides, then filling the bags with 84 g each of detergent powders as set out below. Finally, using an H-M laboratory bar sealer (Hulme-Martin Ltd., London, England) having a range of temperature settings from 1 to 10, on setting '6' the bags were heat sealed to give rectangular filled sachets of about 4½"×4½".

In the product of Example 1 the detergent powder was made by dry mixing in a twin shell dry blender the following ingredients:

| Ingredient | % |
|---|---|
| Sodium alkyl benzene sulphonate | 12.0 |
| Sodium tripolyphosphate | 36.0 |
| Sodium carbonate | 15.0 |
| Silicone | 0.5 |
| Sodium perborate | 25.0 |
| Sodium carboxymethylcellulose | 0.8 |
| Fluorescent agent, perfume | 0.4 |
| Water | 10.3 |

In the product of Example 2 the detergent powder was a high bulk density (0.68 g/cc) product prepared by a granulation process as described in Belgian Pat. No. 867 038 (U.S. application Ser. No. 905,681) to the formulation:

| Ingredient | % |
|---|---|
| Nonionic detergent surfactant | 14.0 |
| Sodium carbonate | 34.0 |
| Calcium carbonate (80 m$^2$/g) | 18.0 |
| Sodium perborate | 25.0 |
| Sodium carboxymethylcellulose | 3.3 |
| Fluorescent agent, perfume | 1.0 |
| Water | 4.7 |

The bags of both Examples were then used to wash fabrics in front loading automatic washing machines by placing the bags inside the drums with the fabrics. It was found that all the bags opened by bursting along one of the seams, and good detergency results were achieved.

The following Example demonstrates the benefit of a mechanically-opening bag over a non-opening bag:

EXAMPLE 3

Bags were constructed using a non-woven bonded fibre fabric consisting of 67% polyester and 33% viscose rayon with an acrylic binder. The fabric weight was 40 g/m$^2$. Each bag was filled with 60 g of a conventional domestic detergent (Persil Automatic) and was sealed using the same heat-sealer as used in Examples 1 and 2. 3 bags were sealed at setting 5 (about 143° C.) to provide weak seals and 3 further bags were sealed at setting 10 (about 240° C.) to provide non-opening seals.

The two types of bag were compared for detergent efficiency when placed through the door of a front-loading automatic washing machine (Hoover Electronic 1100) together with a soiled load, consisting of halved soiled articles and artificially soiled test pieces. The detergent concentration was 0.3%. The water hardness was 25°H (Ca/Mg, 4:1). The 40° C. cycle of the machine was used. Out of 18 halved soiled articles, 11 showed that the bags sealed at setting 5 gave better cleaning, 1 showed that the bags sealed at setting 10 gave better cleaning and 6 showed no difference. The reflectance of the artificially soiled test pieces washed with bags sealed at setting 5 was 62.8%, those washed with bags sealed at setting 10 was 56.2%.

On completion of the wash all bags were recovered and examined. Those formed at heat setting 5 had all opened along one seam. None of the bags formed at heat setting 10 had opened, but all bags were empty of powder.

These results show a significant detergency preference for the mechanically opening bag.

The peel strength of seals formed from 2.5 cm wide strips of the same bag material on the same heat sealer at various heat settings were measured using an Instron TM 1026 tester. The results shown below show a significant difference in peel strength between the opening and the non opening seals, indicating that peel strength is an important factor in the bag opening mechanism.

| Setting | Peel strength (mean of 6 samples) |
|---|---|
| 5 | 409 g |
| 10 | 768 g |

The following Example demonstrates the benefit of a mechanically opening bag over conventional dosing.

EXAMPLE 4

The bag material used was that conventionally used for tea bags, and had a weight of 21 g/m$^2$. Each bag contained 48 g Persil Automatic sealed using the laboratory bar sealer referred to in Example 1, on heat setting 2 (about 80° C.). The bags were placed together with a soiled load directly into a Miele 429 automatic washing machine and the detergency was compared with that obtained with 48 g Persil Automatic dosed via the dispenser of the machine. The washing conditions were otherwise the same as in Example 3.

Out of 18 halved articles, 8 showed that the detergent bags gave better cleaning and 10 showed no difference.

These results show a preference for the bag over conventional dosing, probably as a consequence of mechanical loss of detergent in the latter case.

We claim:

1. In a detergent product in the form of a particular detergent composition suitable for treating fabrics in a washing machine, contained within a closed water-insoluble bag adapted to open in a washing machine environment, the improvement which comprises forming said bag at least partially of thermoplastic material and closing said bag with a mechanically weak heat seal including a layer of water-insoluble non-heat-sealable material positioned between the heat sealed surfaces to provide weakening of said heat seal, whereby under the influence of mechanical action during a wash cycle in a washing machine said mechanically weak heat seal opens and the contents of said bag are discharged.

2. In a detergent product in the form of a particulate detergent composition suitable for treating fabrics in a washing machine, contained within a closed water-insoluble bag adapted to open in a washing machine environment, the improvement which comprises forming said bag from a first sheet of material which heat-seals at a relatively low temperature and a second sheet of non-heat-sealable material or material which heat-seals at a higher temperature than said first sheet, said first and second sheets being heat-sealed together to form a mechanically weak heat seal, whereby under the influence of mechanical action during a wash cycle in a washing machine said mechanically weak heat seal opens and the contents of said bag are discharged.

* * * * *